US005419055A

United States Patent [19]

Meadows

[11] Patent Number: 5,419,055

[45] Date of Patent: May 30, 1995

[54] CONSTRUCTION APPARATUS

[76] Inventor: Dexter L. Meadows, P.O. Box 81942, Bakerfield, Calif. 93280-1942

[21] Appl. No.: 145,653

[22] Filed: Oct. 28, 1993

Related U.S. Application Data

[63] Continuation of Ser. No. 828,323, Jan. 29, 1992, abandoned.

[51] Int. Cl.[6] ..... E04G 17/00

[52] U.S. Cl. ..... 33/518; 52/365; 52/678; 249/219.1; 33/404

[58] Field of Search ..... 33/19, 404, 518, 529; 52/295, 365, 699, 678; 249/219.1, 205, 83, 85, 93; 269/904; 248/225.31, 544

[56] References Cited

U.S. PATENT DOCUMENTS

| | | | |
|---|---|---|---|
| Re. 24,044 | 7/1955 | Breuninger . | |
| 1,130,926 | 3/1915 | Peck . | |
| 1,320,352 | 10/1919 | Werner . | |
| 1,336,004 | 4/1920 | Victoria . | |
| 1,609,912 | 12/1926 | Mazeau . | |
| 2,758,379 | 8/1956 | Senk . | |
| 2,934,826 | 5/1960 | Klaum . | |
| 3,150,429 | 9/1964 | Shaffer | 52/699 |
| 3,163,909 | 1/1965 | Williams | 249/93 |
| 3,279,070 | 10/1966 | Blount et al. . | |
| 3,413,773 | 12/1968 | Fitzgerald | 52/295 |
| 3,425,127 | 2/1969 | Long et al. . | |
| 3,451,136 | 6/1969 | Shuttle, Jr. . | |
| 3,837,060 | 9/1974 | Stehling | 269/904 |
| 3,861,046 | 1/1975 | Arn . | |
| 3,890,717 | 6/1975 | Haun . | |
| 4,080,739 | 3/1978 | Ruhaak . | |
| 4,092,782 | 6/1978 | Raybon | 33/529 |
| 4,095,343 | 6/1978 | McPhail . | |
| 4,141,146 | 2/1979 | Broom . | |
| 4,261,544 | 4/1981 | Addison | 249/93 |
| 4,387,543 | 6/1983 | Tschan et al. | 52/295 |
| 4,736,554 | 4/1988 | Tyler | 249/93 |
| 4,932,134 | 6/1990 | Meadows . | |
| 5,058,854 | 10/1991 | Bravo | 249/219.1 |
| 5,060,436 | 10/1991 | Dellado, Jr. | 52/699 |

FOREIGN PATENT DOCUMENTS 700207 11/1953 United Kingdom .

*Primary Examiner*—Thomas B. Will
*Attorney, Agent, or Firm*—Poms, Smith, Lande & Rose

[57] ABSTRACT

Construction apparatus used for positioning column base brackets, for positioning hold down plates used to position anchor bolts for steel beams, for constructing brick or block walls and columns, and for positioning concrete forms.

2 Claims, 10 Drawing Sheets

FIG. 5
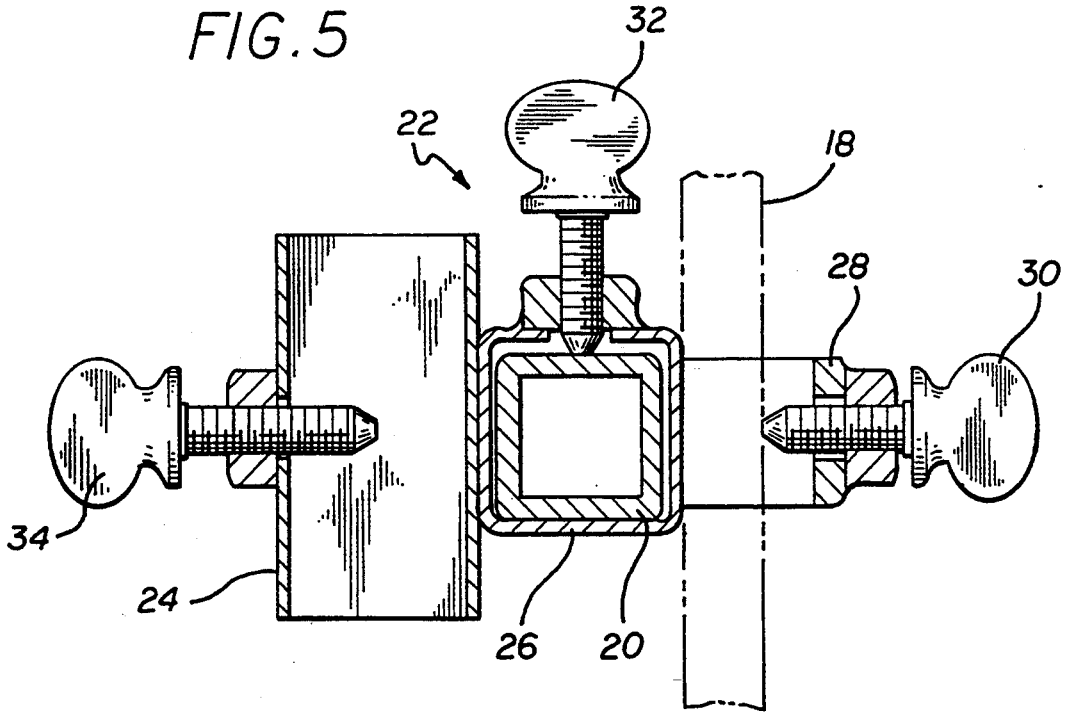
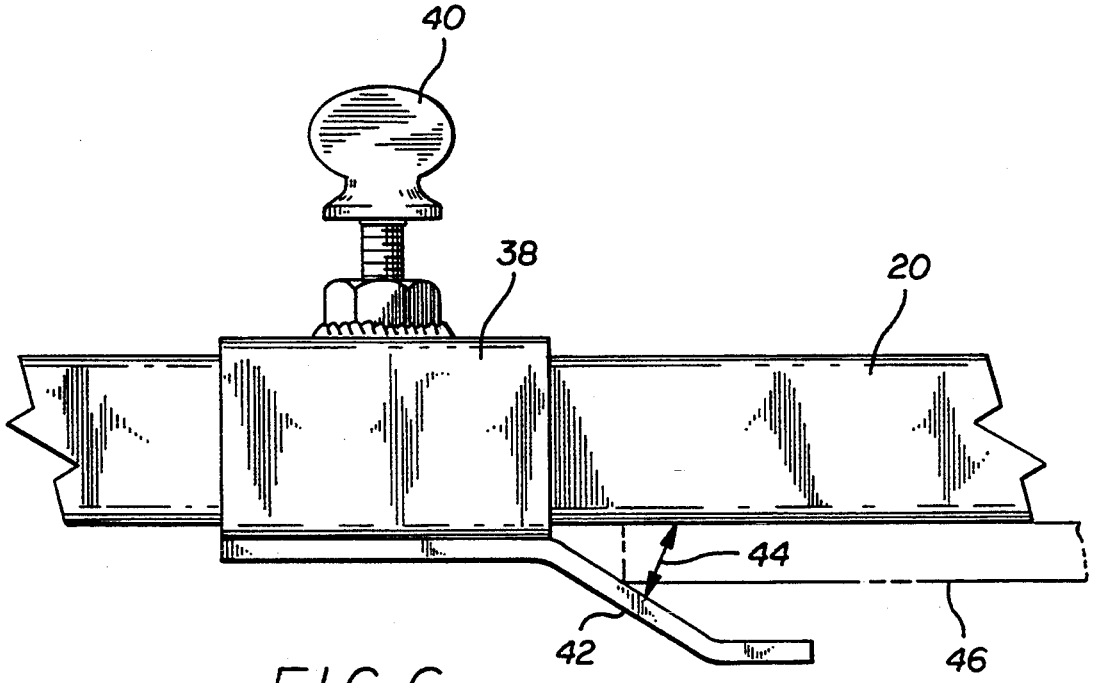
FIG. 6

CONSTRUCTION APPARATUS

This is a continuation of application Ser. No. 07/828,323 filed on Jan. 29, 1992 now abandoned.

BACKGROUND OF THE INVENTION

The present invention relates generally to construction apparatus, and more particularly to construction apparatus used for positioning column base brackets, for positioning hold down plates used to position anchor bolts for steel beams, for positioning rebar or bolts, for constructing brick or block walls and columns, and for positioning concrete forms.

An adjustable foundation locating device is disclosed in my U.S. Pat. No. 4,932,134, issued on Jun. 12, 1990 This device is used to position or locate forms and trenches needed for pouring concrete foundations. The device uses sleeve members which slide back and forth along elongated members supported by stakes. Strings are attached to the sleeve members and used to locate forms and trenches. However, there is a need for other apparatus or devices which may be used for construction work.

SUMMARY OF THE INVENTION

It is an object of this invention to provide construction apparatus which may be used for positioning column base brackets.

It is another object of this invention to provide construction apparatus which may be used for positioning hold down plates used to position anchor bolts for steel beams.

It is still another object of this invention to provide construction apparatus which may be used for constructing brick or block walls and columns.

It is still another object of this invention to provide construction apparatus which may be used for positioning concrete forms.

It is still another object of this invention to provide construction apparatus which may be used for positioning rebar or bolts.

It is still another object of this invention to provide construction apparatus that are easy to use and economical to manufacture.

These and other objects and advantages are attained by construction apparatus used for positioning column base brackets, for positioning hold down plates used to position anchor bolts for steel beams, for constructing brick or block walls and columns, and for positioning concrete forms.

The various features of the present invention will be best understood together with further objects and advantages by reference to the following description of the preferred embodiments taken in conjunction with the accompanying drawings.

BRIEF DESCRIPTION OF THE DRAWINGS

FIG. 5 is a partial cross-sectional view taken in the direction of arrows 5—5 shown in FIG. 4;

FIG. 6 is a view of the sleeve member with attached inclined plate taken in the direction of arrows 6-6 shown in FIG. 5;

DESCRIPTION OF THE PREFERRED EMBODIMENTS

The following specification taken in conjunction with the drawings sets forth the preferred embodiments of the present invention in such a manner that any person skilled in the art can use the invention. The embodiments of the invention disclosed herein are the best modes contemplated by the inventor for carrying out his invention in a commercial environment, although it should be understood that various modifications can be accomplished within the parameters of the present invention.

Figure 1:
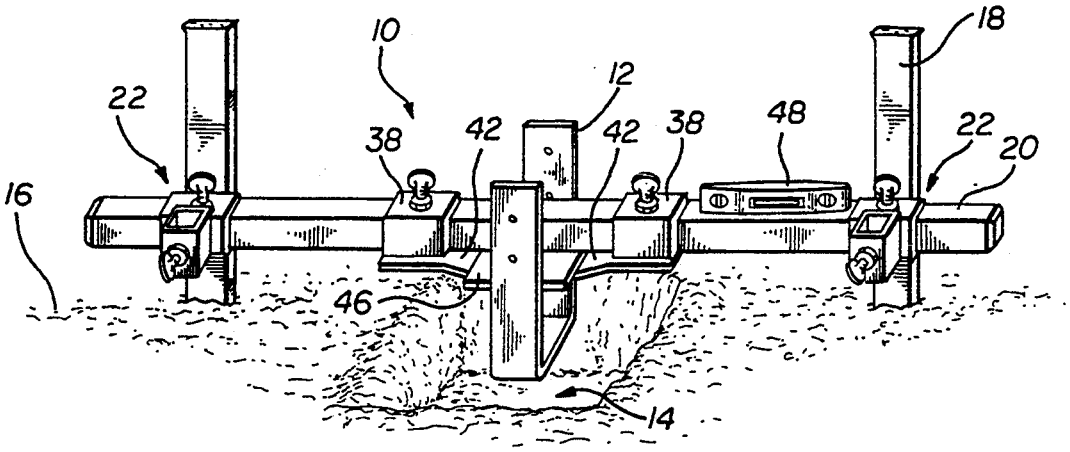
FIG. 1 is a perspective view of construction apparatus of the present invention being used to position a column base bracket for a column in a hole in the ground.

FIG. 1 shows construction apparatus 10 of the present invention which may be used to position a column base bracket 12 for a column in a hole 14 in the ground 16. The hole 14 is filled with concrete which supports the column base bracket 12. Stakes 18 are driven into the ground 16 near the hole 14 for the purpose of supporting an elongated member 20.

Support members 22 are attached to the stakes 18 and support the elongated member 20 as shown in FIG. 1.

One of the support members 22 is shown in FIG. 5. The support member 22 has sleeve members 24, 26 and 28. The stakes 18 engage sleeve members 28 such that the support members 22 may be positioned at different heights on the stakes 18 by selectively loosening and tightening wing nuts 30 engaged to members 28. Similarly, the elongated member 20 engages sleeve members 26 such that the support members 22 may be positioned at different positions along the length of member 20 by using wing nuts 32 that engage members 26.

Figure 2:
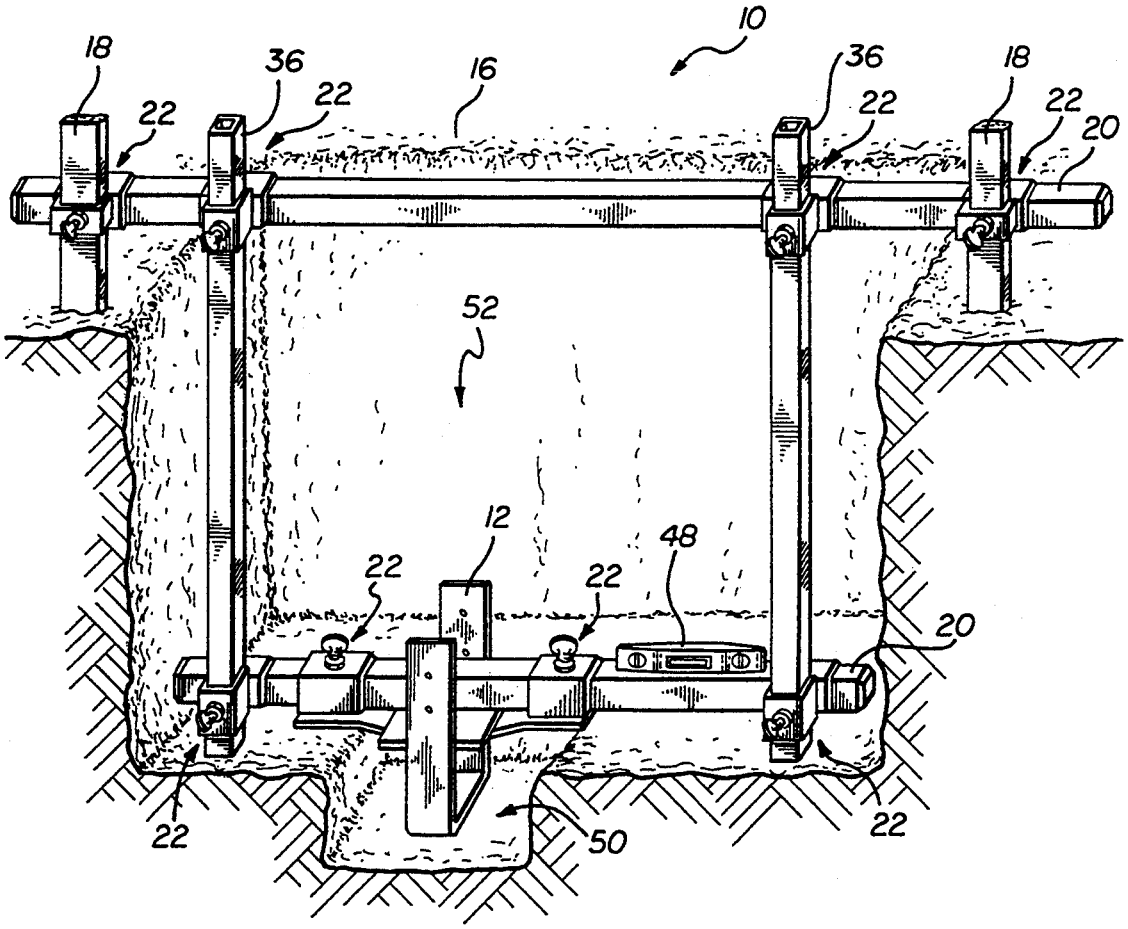
FIG. 2 is a perspective view of construction apparatus of the present invention being used like the apparatus of FIG. 1 to position a column base bracket for a column in a hole located at the bottom of a larger and deeper hole in the ground.

After the support members 22 are positioned along the length of elongated member 20, additional elongated members 36, such as the vertical members 36 shown in FIG. 2, may be engaged to members 22 and positioned at desired heights by loosening and tightening wing nuts 34. Note that such members 36 are not used with the construction apparatus 10 of FIG. 1.

Sleeve members 38 also slidably engage elongated member 20 and may be positioned at any desirable position along the length of member 20 by loosening and tightening wing nuts 40. A detached view of one of the sleeve members 38 is shown in FIG. 6.

The sleeve members, wing nuts, stakes and elongated members of this application may be similar to the parts described in the applicant's U.S. Pat. No. 4,932,134, issued on Jun. 12, 1990, and corrected by Certificate of Correction dated Sep. 24, 1991, the disclosures of which are hereby incorporated by reference thereto.

Each sleeve member 38 has an inclined plate 42 attached to the bottom thereof. The inclined plate 42 may be at any desirable angle 44 which facilitates engaging and supporting plate 46 of column base bracket 12, as best shown in FIG. 6. After the elongated member 20 is positioned at the correct height on stakes 18 using support members 22, the sleeve members 38 are slid along member 20 until the inclined plates 42 engage plate 46 as shown in FIGS. 1, 2 and 6. Note that level 48 may be used to level member 20 as desired. Nuts 40 may then be tightened so that the column base bracket 12 is positioned at a desired height in hole 14. Concrete may then be poured in hole 14 to secure bracket 12 in place.

FIG. 2 shows construction apparatus 10 used to position the column base bracket 12 in a hole 50 located at the bottom of a larger hole 52. As shown in FIG. 2, an upper elongated member 20 may be supported by support members 22 supported by stakes driven into the ground 16 above the larger hole 52. Two additional support members 22 may then be attached to the upper elongated member 20 and used to support vertical elongated members 36 near the top ends thereof. A lower elongated member 20 may then be supported near the bottom ends of vertical members 36 by two additional support members 22 so that the column base bracket 12 is located near the bottom of hole 52 at a desired height in hole 50. Note that the column base bracket 12 is supported on the lower elongated member 20 by two sleeve members 38 with inclined plates 42.

Figure 3:
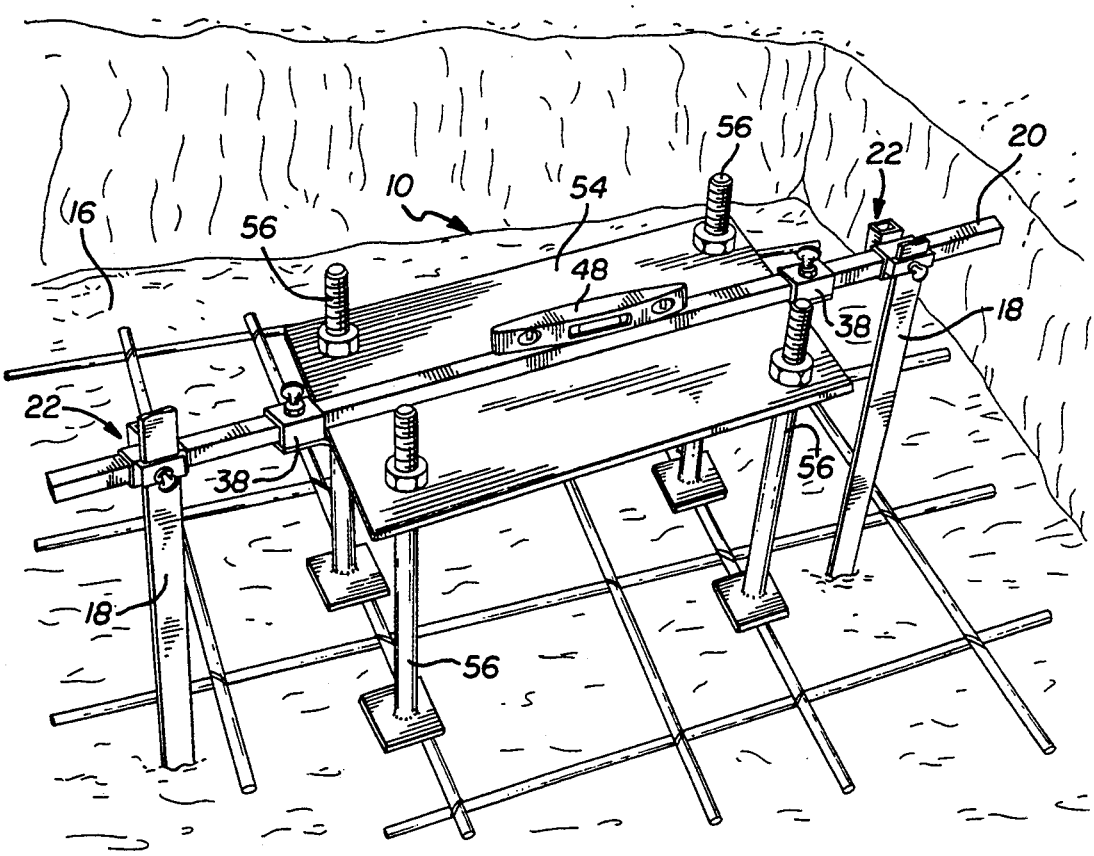
FIG. 3 is a perspective view of construction apparatus of the present invention being used to position a hold down plate used to position anchor bolts for a steel beam.
Figure 4:
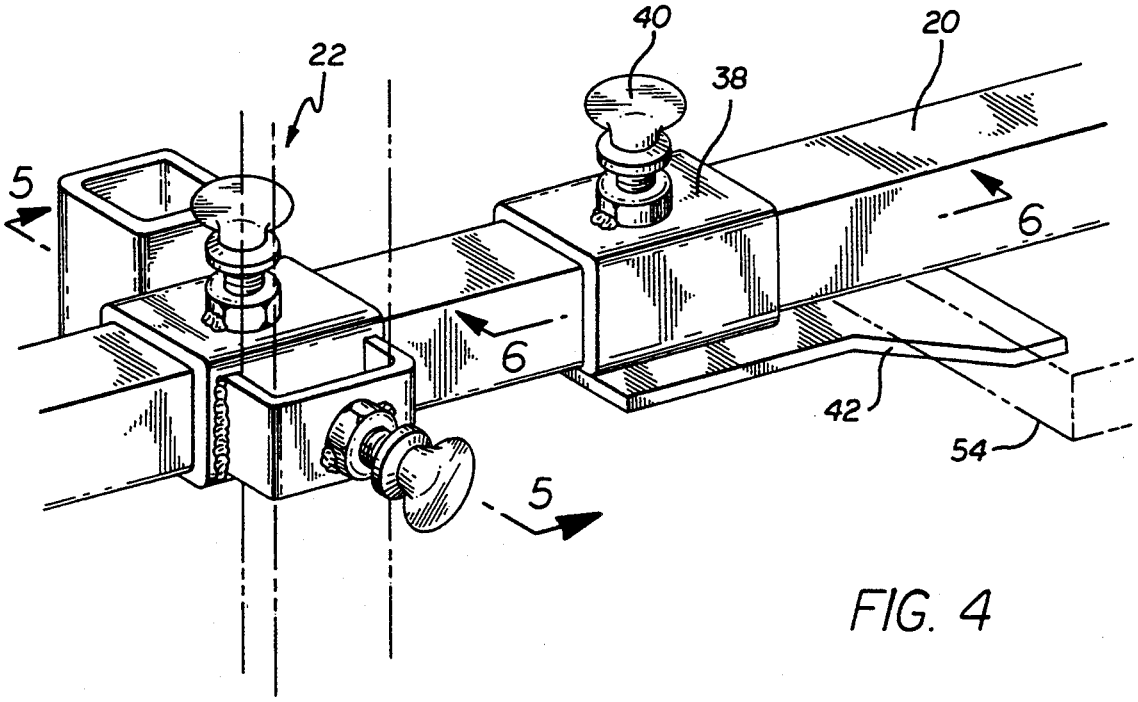
FIG. 4 is an enlarged, detailed perspective view of a sleeve member of the construction apparatus of FIG. 3 showing an inclined plate attached to the sleeve member which is used to position the hold down plate at the correct height above the ground.

Another embodiment of the construction apparatus 10 is shown in FIGS. 3 and 4. Apparatus 10 is used to position a hold down plate 54. The hold down plate 54 is used to position anchor bolts 56 for a steel beam. As shown in FIG. 3, two sleeve members 38 with inclined plates 42 on the elongated member 20 engage the hold down plate 54 and position the anchor bolts 56 at a desired height. The elongated member 20 is positioned at a desired height by two support members 22 which attach the member 20 to two stakes 18 driven into the ground 16. A level 48 may be used to level the elongated member 20.

Figure 7:
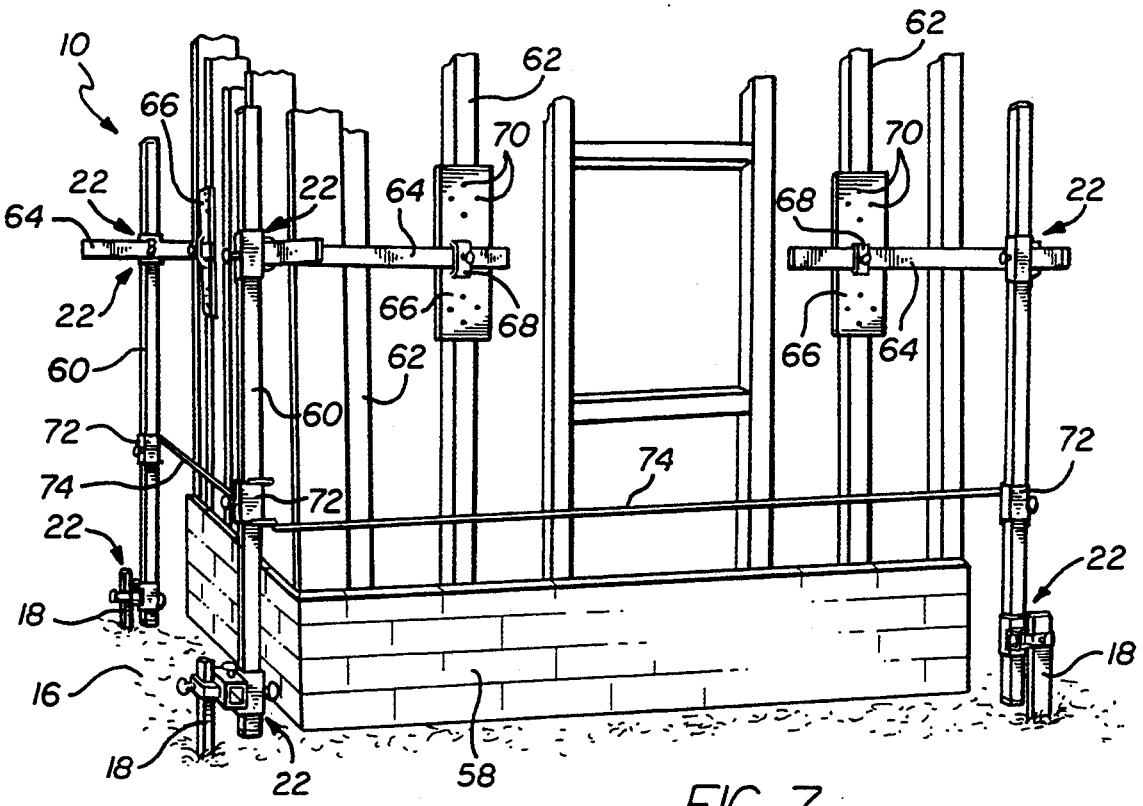
FIGS. 7 through 10 are perspective views of the construction apparatus of the present invention used to construct brick or block walls.
Figure 8:
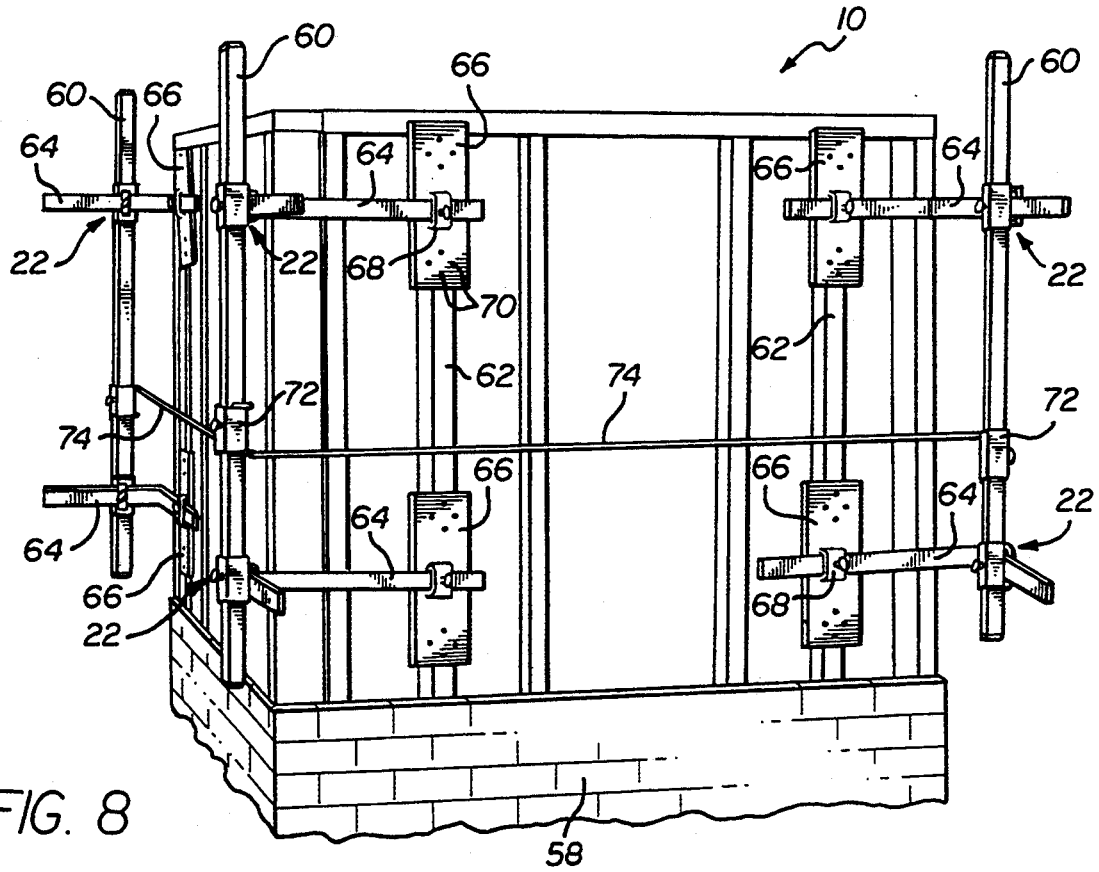

FIGS. 7 and 8 show construction apparatus 10 which may be used to construct a block or brick wall 58. Stakes 18 are driven in the ground 16 near the corners of the wall 58. Vertical elongated members 60 may then be attached to the stakes 18 at desired heights by using support members 22 that are attached to the stakes 18. The vertical members 60 may then be anchored or attached to the supporting frame 62 behind the wall 58 by additional horizontal elongated members 64. One end of each horizontal member 64 is attached to one of the vertical members 60 by support member 22, and the other end of member 64 is attached to a wooden or steel member 66 by a bracket 68. Each member 66 is, in turn, attached to frame 62 by nails 70 or other fasteners.

After the vertical members 60 are positioned as shown in FIG. 7, sleeve members 72 may be positioned at a desired height on the members 60, and string 74 may be attached to the sleeve members 72 to guide workmen in laying bricks for the wall 58. As such, level rows of bricks may be constructed for the wall 58. Sleeve members 72 may be like the sleeve members with nails disclosed in U.S. Pat. No. 4,932,134, the disclosure of which is hereby incorporated by reference thereto.

As the string 74 moves higher up the wall 58, the vertical elongated members 60 may be removed from the stakes 18 and additional horizontal members 64 may be used to support the members 60 on the frame 62 as shown in FIG. 8. As a result, the string 74 may be moved to the top of the brick wall 58 for completion of the wall.

Figure 9:
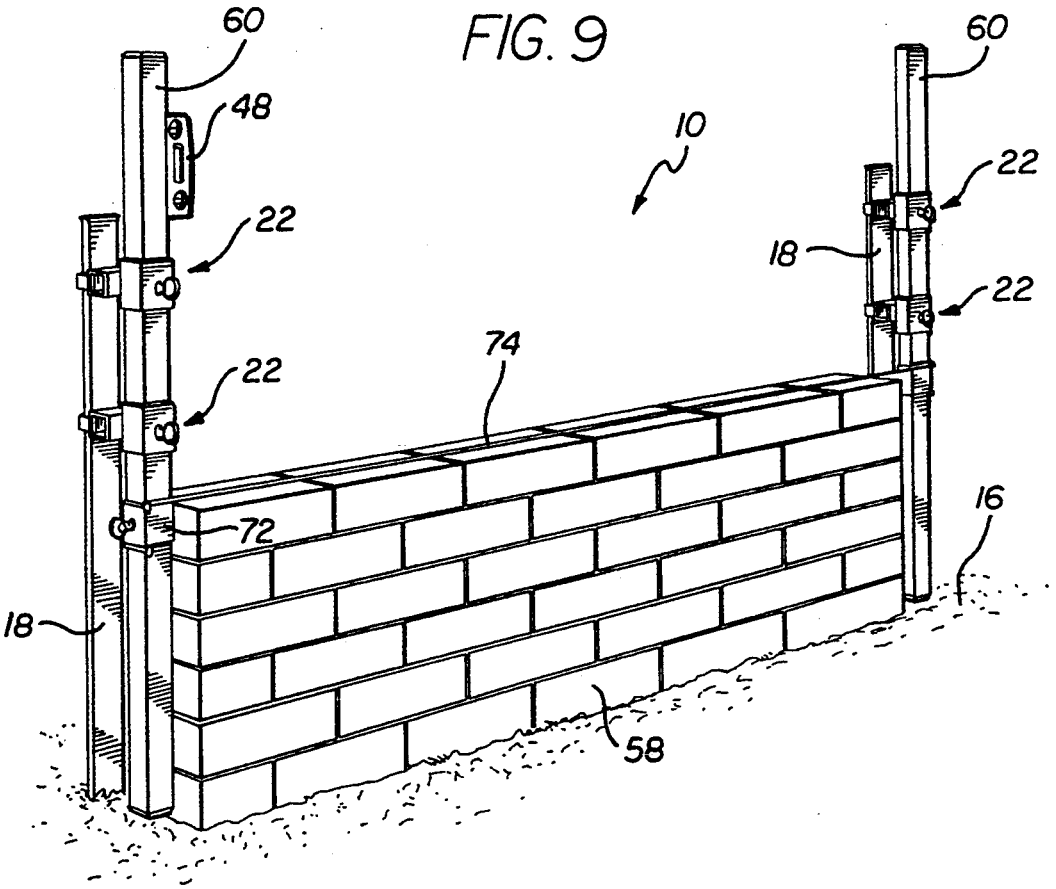

FIG. 9 shows another construction apparatus 10 that may be used to construct a single brick wall 58. Vertical elongated members 60 are supported at each end of the wall 58 by stakes 18 driven into the ground 16. Members 60 are attached to the stakes 18 by support members 22. A level 48 may be used to achieve vertical alignment of members 60. Sleeve members 72 may then be used to position string 74 as shown in FIG. 9 in order to guide workmen in laying bricks.

Figure 10:
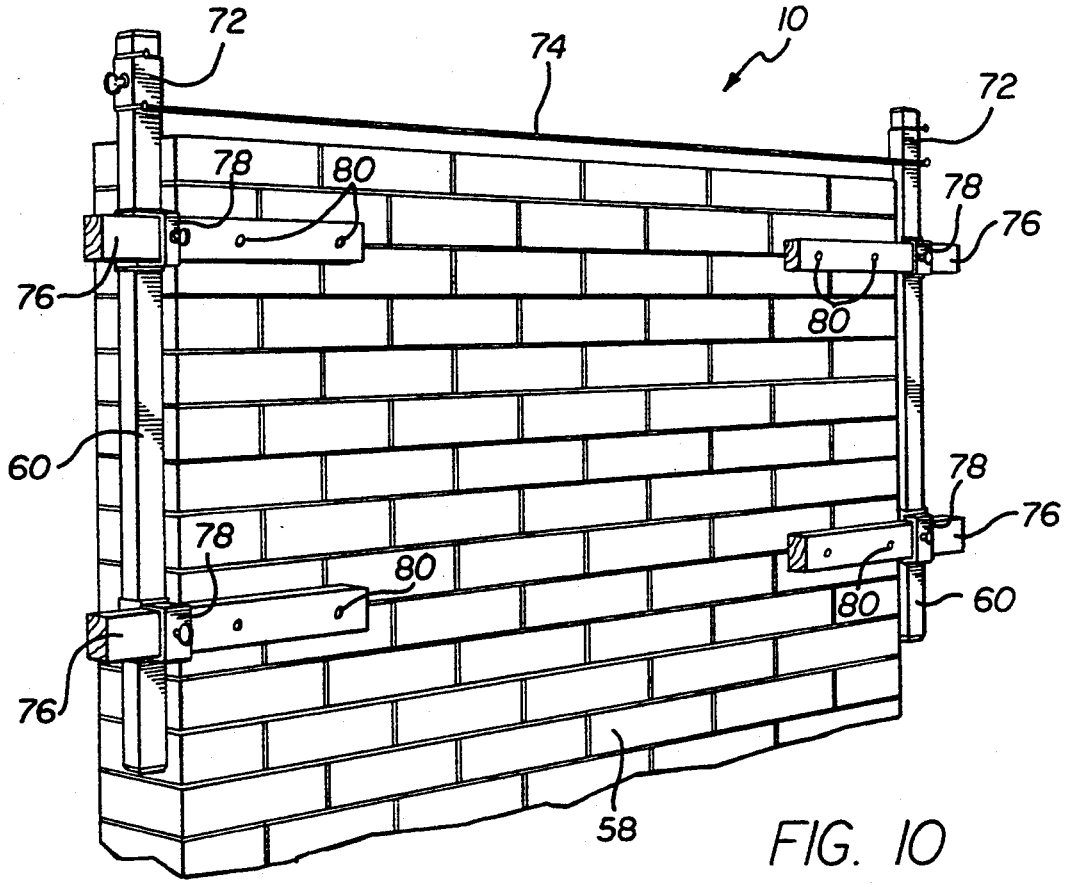

FIG. 10 shows how the vertical members 60 may be removed from the stakes 18 and attached to the wall 58 by wood or steel members 76. Nails or members 80 attached to the members 76 are driven into the mortar between the bricks and used to attach the members 76 to the wall 58. Members 76 may be attached to the vertical members 60 by brackets 78 as shown in FIG. 10 or by support members 22, if desired. Brackets 78 may be replaced by any of the brackets disclosed in U.S. Pat. No. 4,932,134, the disclosure of which is hereby incorporated by reference thereto.

The members 76 may be repositioned up the wall 58 by removing nails 80 from the mortar between the rows of bricks, and forcing the nails 80 into mortar located higher up the wall 58. Sleeve members 72 may be moved up members 60 in order to locate the string 74 at a desirable level.

Figure 11:
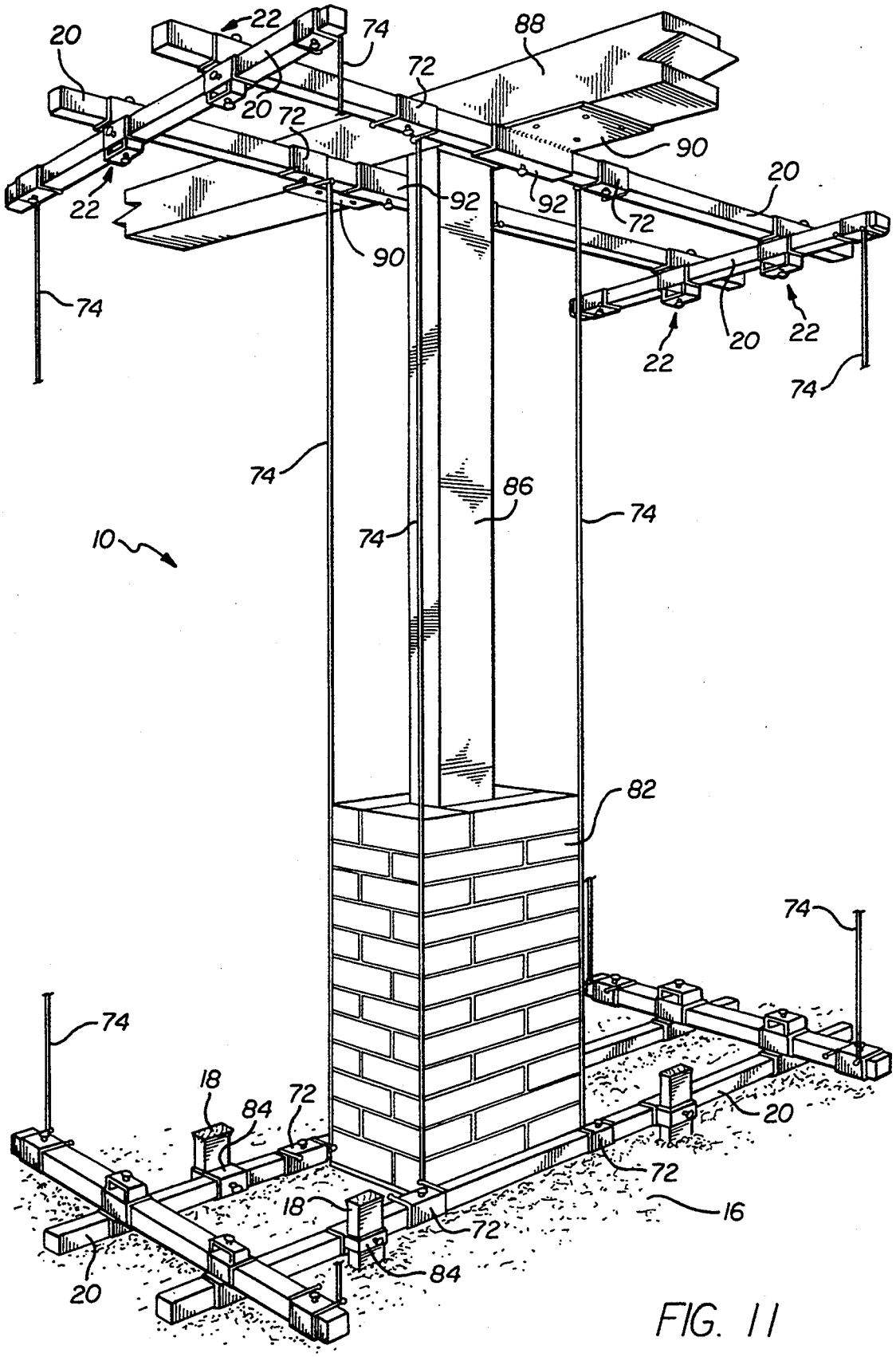
FIG. 11 is a perspective view of construction apparatus of the present invention used to construct a brick or block column.

Construction apparatus 10 is shown in FIG. 11 which may be used to construct a brick or block column 82. The apparatus 10 is used to position strings 74 for the purposes of guiding workmen in laying rows of brick for the column 82.

Two lower elongated members 20 are positioned at the base of the column 82 by stakes 18 driven into the ground 16 which are attached to brackets 84. The brackets 84 attach members 20 to the stakes 18. As shown, the bottom ends of guide strings 74 are attached to sleeve members 72 engaged to the members 20. The sleeve members 72 allow the bottom ends of the strings 74 to be positioned at any desirable locations.

As shown in FIG. 11, the column 82 has a central vertical member 86 which supports a beam 88 at the top end thereof. Plates 90 are used to mount two additional upper elongated members 20 to beam 88 at the top of vertical member 86. The plates 90 have sleeve members or brackets 92 which facilitate attaching the elongated members 20 to the plates 90. Sleeve members 72 are then used to secure the top ends of the strings 74 to members 20 at any desirable positions. After the strings 74 are positioned, workmen may build up the rows of brick using the strings 74 as guides.

Note that additional elongated members 20 may be mounted to the ends of the upper elongated members 20 by support members 22. These members 20 may then be used to position other strings 74 as illustrated in FIG. 11.

Figure 12:
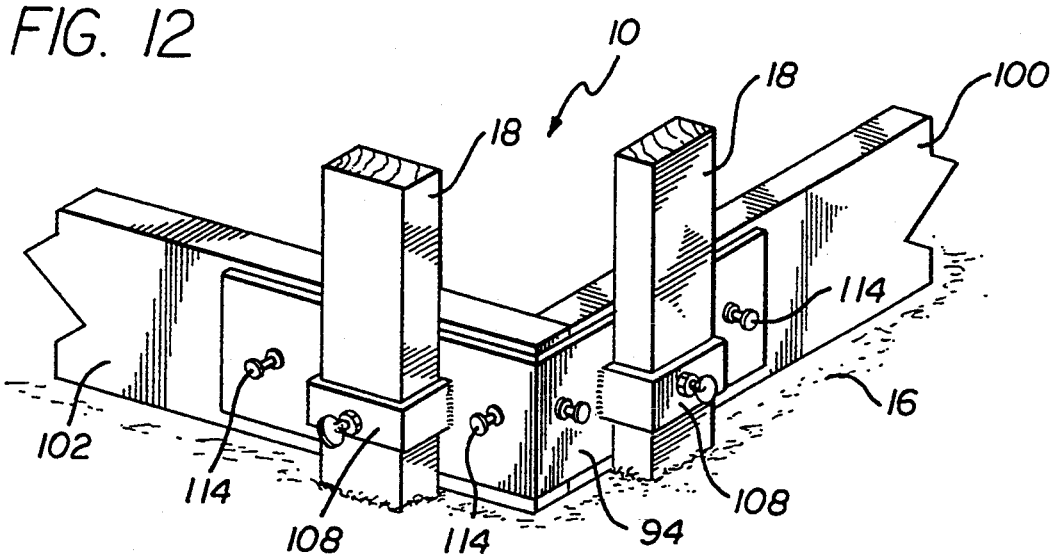
FIGS. 12 through 14 are perspective views of butt plates of the present invention used to position forms.
Figure 13:
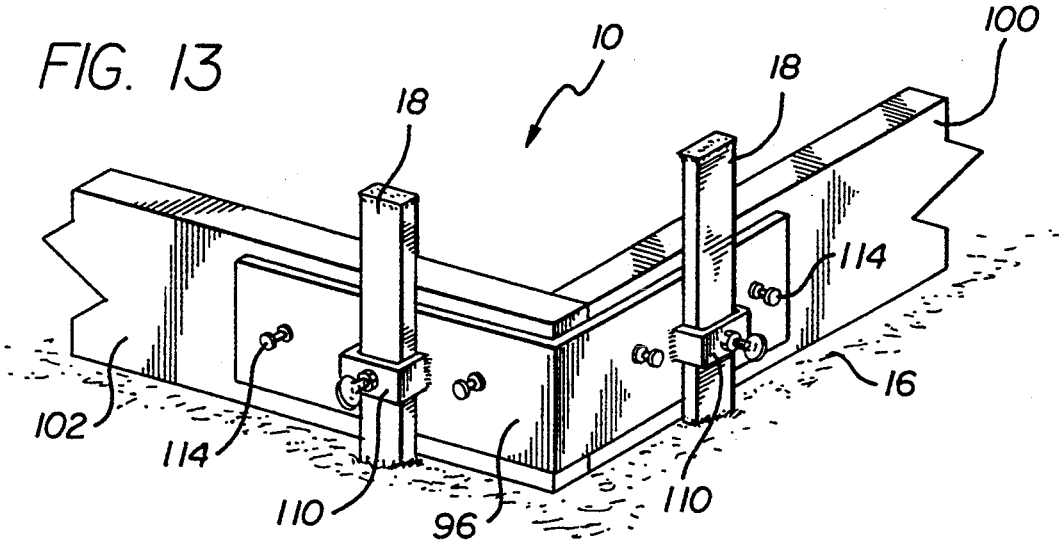
Figure 14:
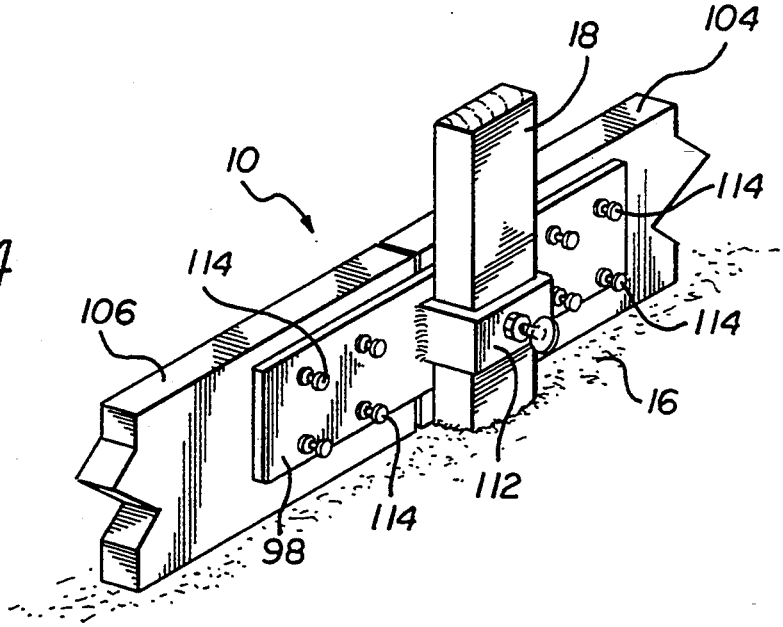

FIGS. 12 through 14 show views of butt plates 94, 96 and 98 used as construction apparatus 10 to position forms 100 through 106. The corner butt plates 94 and 96 are secured to stakes 18 driven into the ground 16 by brackets 108. Nails or members 114 are used to secure the plates to forms 100 and 102. The flat butt plates 98 shown in FIG. 14 is secured to stake 18 by bracket 112 and members 114 are used to attach the plate 98 to the forms 104 and 106.

Figure 15:
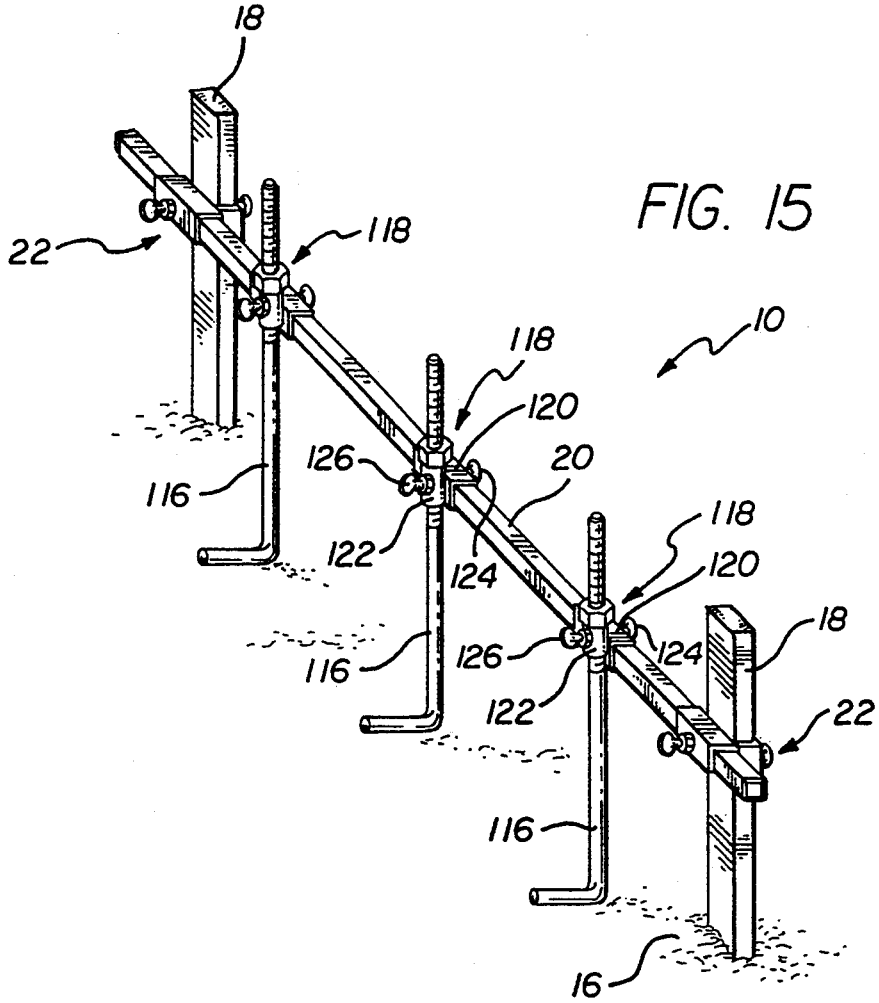
FIGS. 15 and 16 are perspective views of construction apparatus of the present invention used to position bolts.
Figure 16:
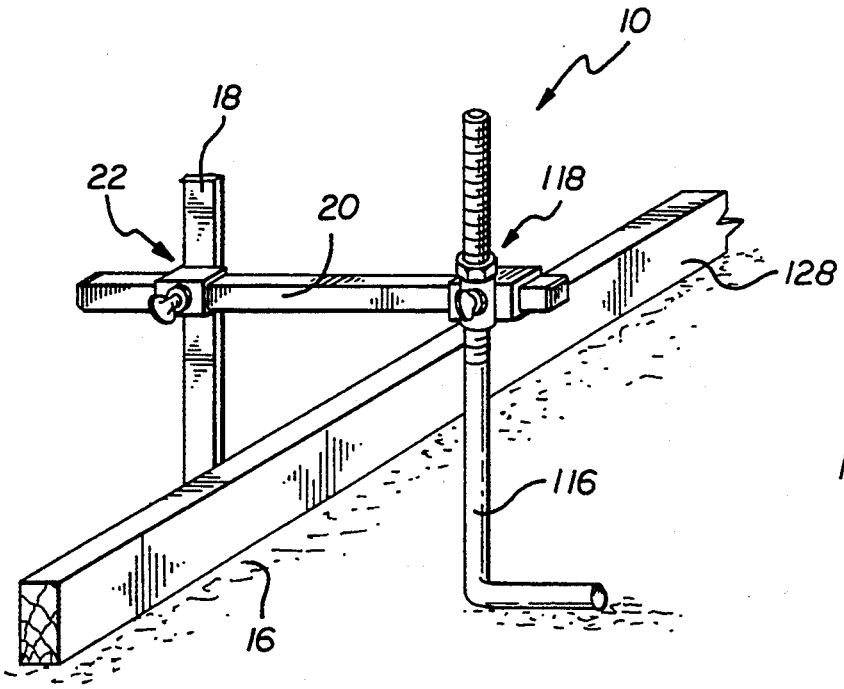

FIGS. 15 and 16 show construction apparatus 10 used to position rebar or bolts 116. An elongated member 20 is secured by bolt support members 122 to a stake 18 driven into the ground 16. Butt support members 118 are used to attach the bolts 116 to the elongated member 20 at different locations along the length of member 20. Each of the bolt support members 118 has a sleeve member 120 and a generally cylindrical sleeve member 122. Each sleeve member 120 may be slid along member 20 and positioned at any desirable location using its corresponding wing nut 124. Each bolt 116 engages its corresponding cylindrical sleeve member 122 and may be positioned at any desirable height using its corresponding wing nut 126.

FIG. 16 shows a single elongated member 20 which is secured to stake 18 by support member 22. One of the bolt support members 122 is used to secure bolt 116 near the end of member 20 so that member 20 and bolt 116 extend over support 128.

Figure 17:
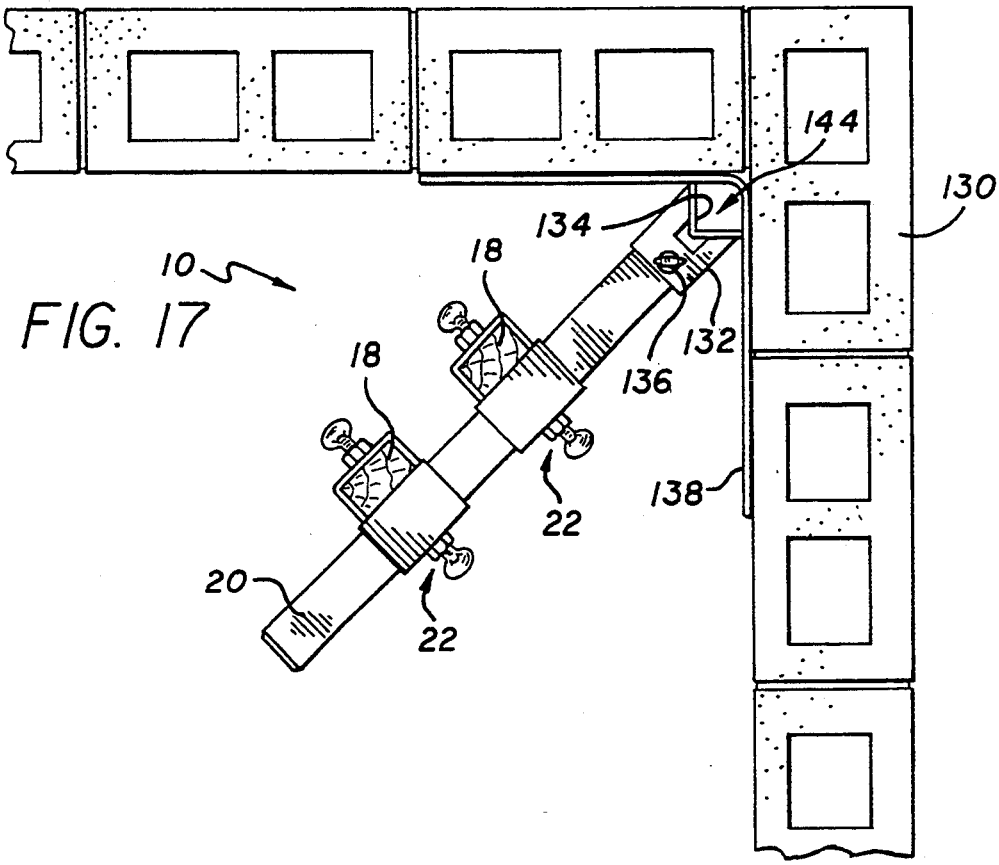
FIGS. 17 and 18 are perspective views of construction apparatus of the present invention used to construct brick or block walls.
Figure 18:
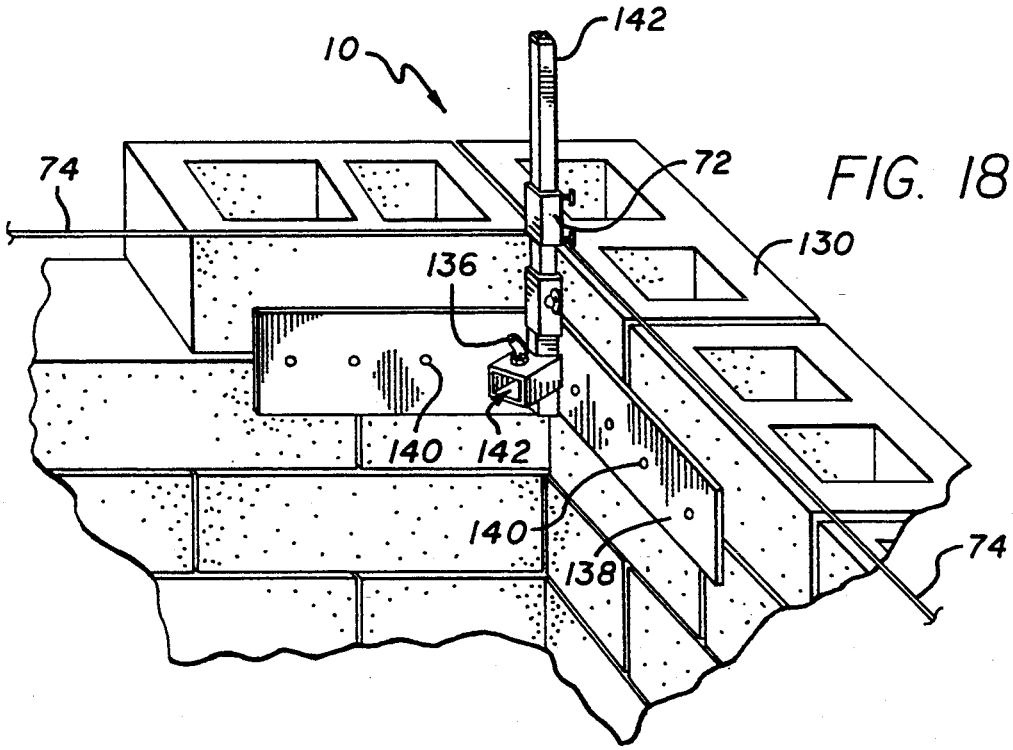

Construction apparatus 10 are shown in FIGS. 17 and 18 which may be used to construct a block or brick wall 130. An angle corner plate 138 is attached to an elongated member 20 by member 132 attached to the plate 138. Member 20 is attached by support members 20 to stakes 18 driven into the ground 16. One end of member 20 is inserted into opening 142 in member 132 and nut 136 is used to secure the end to member 132. Another opening 144 is formed by angle plate 134 adjacent member 132.

Another elongated member 142 may be inserted into opening 144 and secured to member 132 using any desirable means. Sleeve member 72 on member 142 may be used to position string 74 at any desirable height.

The angle corner plate 138 may be used without elongated member 20 as shown in FIG. 18. Nails or members 140 may be driven into mortar between the rows of bricks for the purpose of supporting plate 138. Therefore, the plate 138 may be moved to different heights up the wall 130 by using nails 140 to support the plate.

Figure 19:
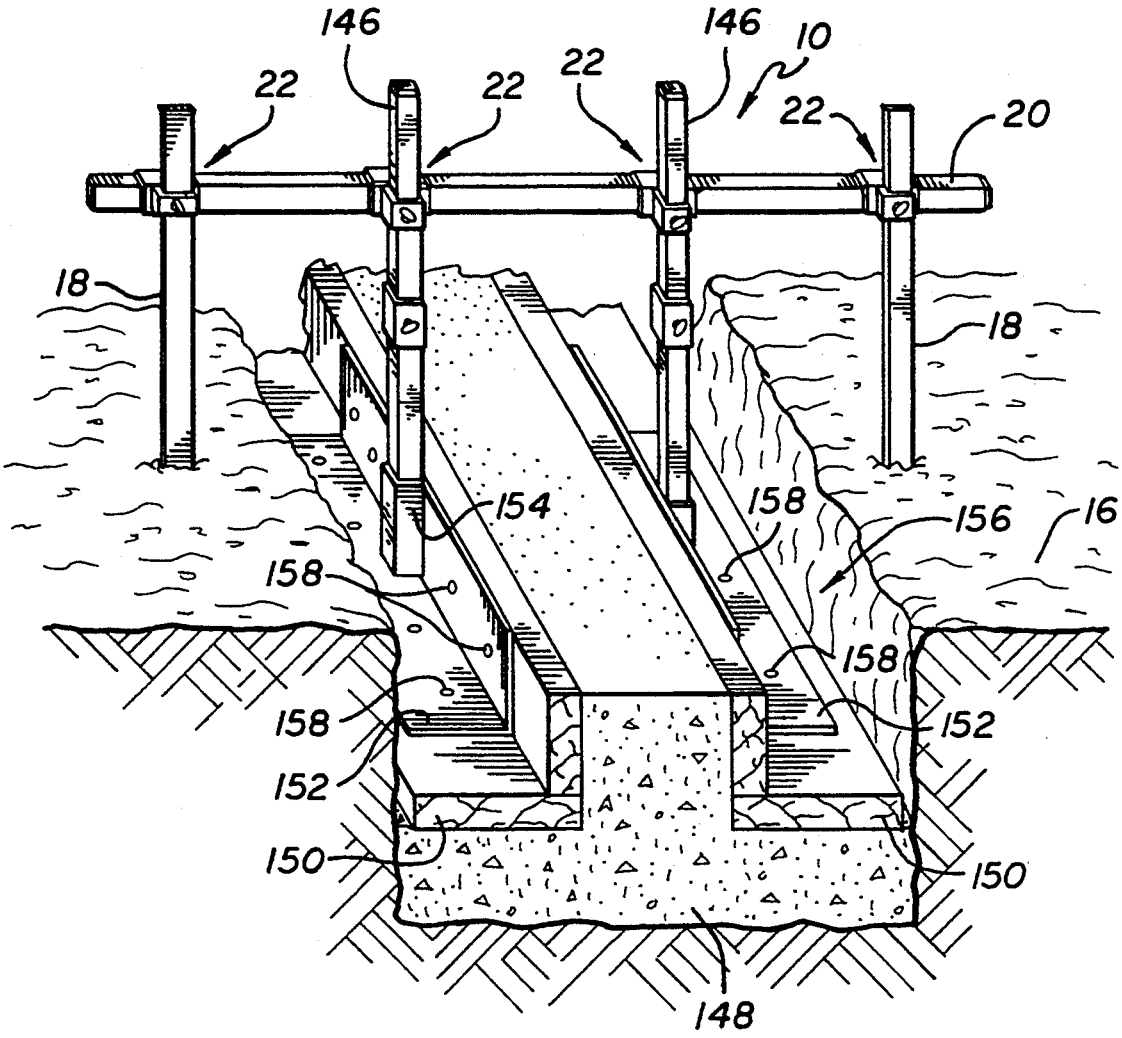
FIG. 19 is a perspective view of construction apparatus of the present invention used to position forms.

FIG. 19 also shows construction apparatus 10 used to position forms 150 in trenches 156. As shown, stakes 18 positioned on opposite sides of the trenches 156 are used to support horizontal elongated member 20. Vertical elongated members 146 are then supported on elongated member 20 by support members 22. As shown, the bottom ends of the elongated members 146 are inserted into brackets 154, which are attached to angled plates 152. Nails 158 may be used to attach the plates 152 to the forms 150 so that the forms are correctly positioned in the trenches 156.

The above description discloses the preferred embodiments of the present invention. However, persons of ordinary skill in the art are capable of numerous modifications once taught these principles. Accordingly, it will be understood by those skilled in the art that changes in form and details may be made to the above-described embodiments without departing from the spirit and scope of the invention.

I claim:

1. Construction apparatus used with stakes to position a construction member having a supporting plate, comprising:

an elongated member releasably coupled to said stakes and selectively positioned vertically on said stakes at a selected height;

means for releasably engaging said elongated member to said stakes and for holding said elongated member in a substantially horizontal position; and a pair of support means slidably engaging and fitting around said elongated member, each of said support means adapted to be selectively positioned along said elongated member for engaging said supporting plate of said construction member in order to support said construction member, for positioning said supporting plate in a substantially horizontal position, and for positioning said construction member, each of said support means including an inclined plate engaging said supporting plate, said pair of support means cooperating to hold said supporting plate in said substantially horizontal position

2. A method of positioning a construction member having a supporting plate, comprising the steps of:

driving two stakes into a supporting surface;

selectively positioning an elongated member at a selected height from said supporting surface;

releasably securing said elongated member to said stakes; slidably engaging and fitting around said elongated member a pair of support means, each of which includes an inclined plate adapted to engage one end of said supporting plate;

sliding each of said support means longitudinally along said elongated member until said unlined plates engage said supporting plate and hold said supporting plate in a substantially horizontal position; and securing supporting plate, each of said support means to said elongated member.

* * * * *